US005476074A

United States Patent [19]

Boggs et al.

[11] Patent Number: 5,476,074

[45] Date of Patent: Dec. 19, 1995

[54] VARIABLE COMPRESSION HEIGHT PISTON FOR INTERNAL COMBUSTION ENGINE

[75] Inventors: David l. Boggs, West Bloomfield; Michael M. Schechter, Farmington Hills, both of Mich.

[73] Assignee: Ford Motor Company, Dearborn, Mich.

[21] Appl. No.: 266,393

[22] Filed: Jun. 27, 1994

[51] Int. Cl.[6] ..... F02B 75/04

[52] U.S. Cl. ..... 123/48 B; 123/78 B

[58] Field of Search ..... 123/48 B, 78 B

[56] References Cited

U.S. PATENT DOCUMENTS

| | | | |
|---|---|---|---|
| 3,303,831 | 2/1967 | Sherman . | |
| 3,704,695 | 12/1972 | Cronstedt | 123/78 B |
| 3,777,724 | 12/1973 | Kiley | 123/78 B |
| 3,934,560 | 1/1976 | Dodd | 123/48 B |
| 4,016,841 | 4/1977 | Karaba et al. | 123/78 B |
| 4,079,707 | 3/1978 | Karaba et al. | 123/78 B |
| 4,241,705 | 12/1980 | Karaba et al. | 123/78 B |
| 4,515,114 | 5/1985 | Dang | 123/48 B |
| 4,784,093 | 11/1988 | Pfeffer et al. | 123/78 B |
| 4,785,790 | 11/1988 | Pfeffer et al. | 123/78 B |
| 4,809,650 | 3/1989 | Arai et al. | 123/78 B |
| 4,934,347 | 6/1990 | Suga et al. | 123/78 B |
| 4,979,427 | 12/1990 | Pfeffer et al. | 92/60.5 |
| 5,165,368 | 11/1992 | Schechter | 123/48 B |
| 5,257,600 | 11/1993 | Schechter et al. | 123/78 B |

FOREIGN PATENT DOCUMENTS

| | | | |
|---|---|---|---|
| 0438121 | 7/1991 | European Pat. Off. | 123/48 B |
| 58-91340 | 5/1983 | Japan | 123/48 B |
| 60-32948 | 2/1985 | Japan | 123/48 B |
| 3-33440 | 2/1991 | Japan | 123/48 B |

OTHER PUBLICATIONS

SAE Technical Paper Series 901539 "Variable Compression Pistons" Cedric Ashley.

*Primary Examiner*—David A. Okonsky
*Attorney, Agent, or Firm*—Jerome R. Drouillard; Roger L. May

[57] ABSTRACT

A variable compression height piston for reciprocating internal combustion engine includes a lower piston coupled to a connecting rod and an upper piston slidably carried upon the lower piston. A hydraulically actuated mechanical latching system interposed between the lower and upper pistons allows a system controller to selectably maintain the upper piston in a plurality of predetermined compression heights.

13 Claims, 3 Drawing Sheets

VARIABLE COMPRESSION HEIGHT PISTON FOR INTERNAL COMBUSTION ENGINE

SUMMARY OF THE INVENTION

The present invention relates to a piston and control assembly for a reciprocating internal combustion engine in which the compression ratio of the engine may be varied by means of a hydraulically controlled, mechanically locked, latch system which is integrated into the piston.

DISCLOSURE INFORMATION

Two-part variable compression ratio pistons have traditionally employed hydraulic control means, including valving, which furnished oil to a volume contained between the upper and lower piston subassemblies. The oil trapped in this volume was variable in quantity, and therefore allowed the compression ratio of the piston to be controlled to a higher or lower level. Unfortunately, because the relative position of the piston parts or, in other words, the compression height, is determined solely by the amount of oil trapped in the volume, quick adjustment of the compression ratio is not possible. As a result, these hydrostatically locked pistons could not generally be operated without undesirable knocking encountered during transition between operation at a higher compression ratio and operation at a lower compression ratio. Knocking would occur because an engine being operated at a speed and load suitable for the high compression ratio could quickly change to a mode of operation suitable only for a lower compression ratio, which would require that the volume of oil maintained in the chamber between the upper and lower piston subassemblies be decreased. This decrease in volume requires that the oil pass through valving and such passage of oil requires time generally in excess of several engine cycles. As a resulting the piston would be operating at a higher than optimal compression height, and the resulting compression ratio of the engine would exceed that which was proper. This, in turn, caused knocking in certain cases.

In contrast with prior art variable compression ratio pistons, the present two-stage compression ratio control system not only allows operation of the engine at two different compression ratios but also allows rapid changing of the compression ratio, in as little time as one cycle. This represents a decided advantage over prior art variable compression ratio piston systems. Although the present system relies on a hydraulic control mechanism, the piston is mechanically locked at one of two compression heights; the present invention does not use hydrostatic locking of the piston. As a result, the present piston offers the capability of rapid adjustment in, as noted above, as little as one engine cycle. The present invention also offers the advantage that the compression ratios are more precisely defined. The present variable compression ratio piston also has a fail-safe feature which places the piston in a lower compression ratio configuration if the engine oil pressure decreases unacceptably.

SUMMARY OF THE INVENTION

A variable compression height piston for a reciprocating internal combustion engine having at least one piston coupled to a crankshaft by means of a connecting rod includes a lower piston coupled to the connecting rod and an upper piston slidably carried upon the lower piston. A hydraulically actuated latching system interposed between the lower and upper pistons selectably maintains the upper piston in a plurality of predetermined compression heights. In a preferred embodiment, the latching system comprises a low compression latch for maintaining the upper piston in a lower compression height, and a high compression latch for maintaining the upper piston at a higher compression height. The low compression latch has a normally engaged configuration, whereas the high compression latch has a normally disengaged configuration. Both sets of latches are responsive to oil pressure signals communicated to the piston by means of an oil passage contained in the connecting rod.

The low compression latches comprise at least one low compression locking key which is linked with a radially extending low compression plunger slidably housed within the lower piston. The low compression plunger is elastically biased so as to urge the low compression locking key into locking contact with the upper piston. The low compression plunger is responsive to oil pressure communicated to the piston by means of the oil passage in the connecting rod such that an elevation in oil pressure within the connecting rod above a predetermined value will cause the low compression plunger to move from a radially outward position in which the low compression locking key is in contact with the upper piston to a radially inward position in which the low compression locking key is free from contact with the upper piston. The high compression latch comprises at least one high compression locking key which is linked with a radially extending high compression plunger which is slidably housed within the lower piston. Each high compression plunger is elastically biased so as to urge the corresponding high compression key into an unlocked position with respect to the upper piston. The high compression plungers are responsive to oil pressure communicated to the piston by means of the common oil passage in the connecting rod such that an elevation in oil pressure within the connecting rod will cause the high compression plunger to move from a radially inward position in which the high compression locking key is not in contact with the upper piston to a radially outward position in which the locking key is in contact with the upper piston such that the compression height of the piston will be increased. The high compression plunger and locking key are free to move to the radially outward position only after the upper piston moves up relative to the lower piston. The relative movement of the upper piston with respect to the lower piston is due to the effect of inertia and combustion forces. With a running engine, these external forces provide all of the driving force needed to move the upper piston to its new location with respect to the lower piston each time it is desired to change the compression ratio. Those skilled in the art will appreciate in view of this disclosure that an engine controller could be employed for the purpose of establishing the compression ratio at an appropriate value each time the engine is shut down.

A system according to the present invention further includes an oil supply system for furnishing oil under pressure to the oil passages in the connecting rods and a controller for operating the oil supply system so as to govern the pressure of oil applied to the connecting rod passages and to the latching systems within the pistons. The controller operates the oil system such that a relatively lower oil pressure is furnished to the connecting rod passage when the upper piston is intended to be at the lower compression height, and a relatively higher pressure is furnished to the connecting rod oil passage when the upper piston is intended to be at the higher compression height.

DETAILED DESCRIPTION OF THE PREFERRED EMBODIMENTS

Figure 1:
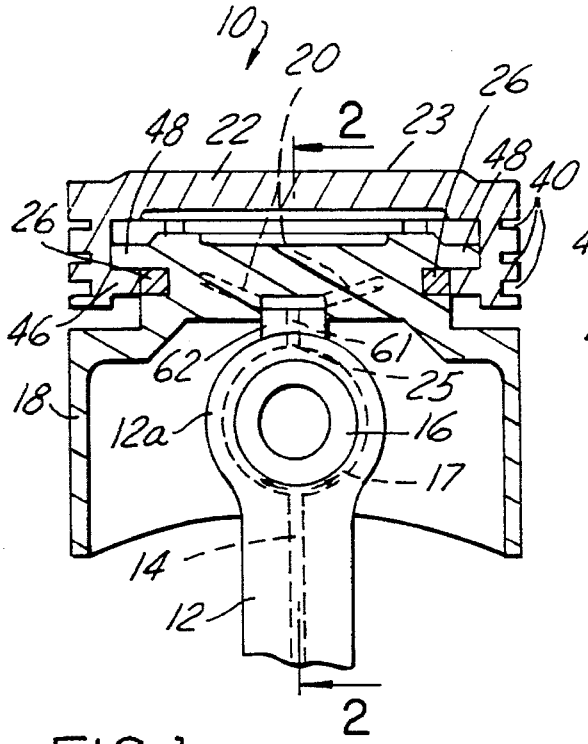
FIGS. 1 and 2 are sectional views of a piston according to the present invention positioned in a high compression position.
Figure 2:
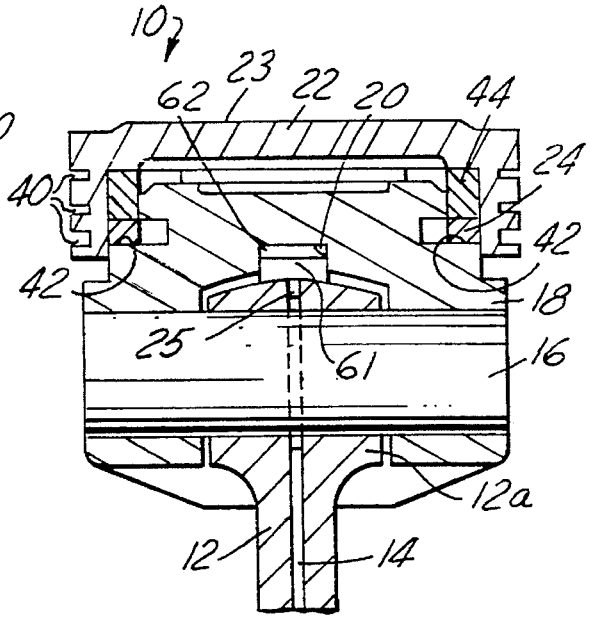

As shown in FIGS. 1 and 2, a variable compression height piston for a reciprocating internal combustion engine includes piston 10 which is mounted upon connecting rod 12 by wrist pin 16. Oil passage 14 extending the length of connecting rod 12 communicates oil pressure from a pump which will be described in further detail below. As oil moves into small end 12a of connecting rod 12, the oil flows into annulus 17, which is formed in the outer cylindrical surface of wrist pin 16. Thereafter the oil flows into passage 61, which is formed in boss 62, which slidingly engages the uppermost part of small end 12*a*. In turn, passage 61 communicates with passage 20, which is shown in greater detail in FIGS. 3 and 6. In this manner, oil pressure is transmitted to the plunger bores within the piston. For the sake of clarity, the various plunger bores are not shown in FIGS. 1, 2, 4, or 5.

Piston 10 includes upper piston 22 and lower piston 18. Upper piston 22 is slidably mounted upon lower piston 18 such that the compression height of the piston, as measured from the centerline of the wrist pin bore to crown 23 of upper piston 22, is adjustable. Because lower piston 18 is mounted to connecting rod 12 by means of wrist pin 16 in conventional fashion, compression height changes whenever upper piston 22 changes its position with respect to lower piston 18. Upper piston 22 functions at least partly in the manner of the upper region of a conventional piston. For example, piston ring grooves 40 are adapted to retain piston rings for sealing compression and for oil control. And, upper piston 22 forms part of the combustion chamber in conventional fashion.

Figure 3:
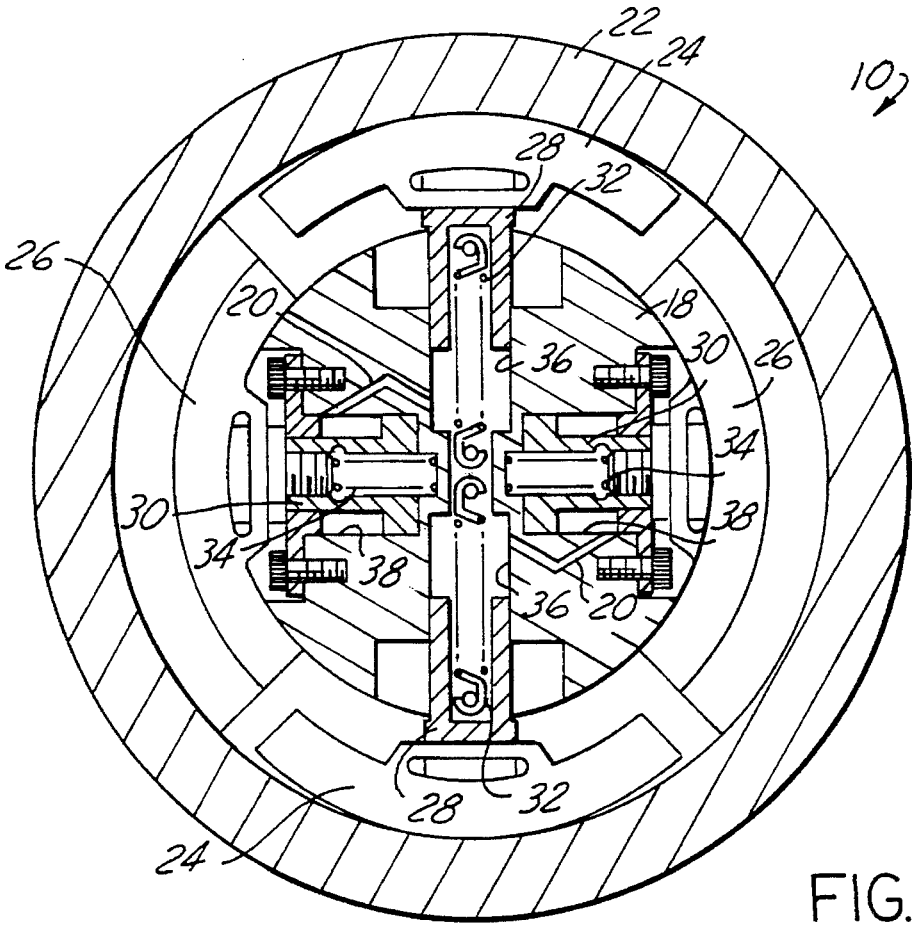
FIG. 3 is a plan view of the piston of FIG. 1 and 2, again in the high compression position.

FIGS. 1, 2, and 3 illustrate piston 10 in the high compression position. Unlike other types of variable compression ratio pistons, the present piston is maintained in either the high or low compression height positions by means of locking keys operated by plungers which are responsive to oil pressure transmitted along passage 14 of connecting rod 12. In the embodiment illustrated herein, four locking keys are used, two for low compression locking, and two for high compression locking. The locking keys and their control elements thus comprise a hydraulically actuated, mechanical latching system which may further be described as a positive latching system. Those skilled in the art will appreciate in view of this disclosure that other locking arrangements, possibly including other numbers of locking elements, may be used according to the present invention.

In FIGS. 1, 2, and 3 the high compression latch mechanism, including the locking keys and plungers, maintains the piston in a higher compression height. This is accomplished as follows: Beginning with FIG. 3, it is seen that high compression locking keys 24 are in a radially outward position. Both of high compression locking keys 24 are placed in the radially outward position by high compression plungers 28, which are housed within high compression plunger bores 36. All of the plungers and bores are located in the same plane within lower piston 18. Thus all of the plungers may be said to be co-planar. This co-planar configuration is important because it allows the piston to have minimum length.

When oil pressure through passage 14 is increased above a predetermined level, oil pressure within bores 36 increases, and plungers 28 are forced radially outwardly within bores 36 against the biasing force of high compression plunger springs 32. The predetermined level must thus be sufficient to overcome the force of plunger springs 32. Because springs 32 tend to maintain plungers 28 in the radially inward position which is characterized by placement of high compression locking keys 24 in their radially innermost position, the high compression latch system comprising keys 24 and plungers 28 has a normally disengaged configuration. Accordingly, if oil pressure decreases below a predetermined level in an engine equipped with a variable compression ratio system according to the present invention, the piston will automatically move to a lower compression height configuration.

As shown in FIGS. 1–3, high compression locking keys 24 are mounted over wrist pin 16. This structure is used because the greater loads associated with higher compression operation are imposed directly upon the wrist pin in this manner. As shown in FIG. 2, high compression locking keys 24 are interposed between a land 42, which is formed on lower piston 18, and abutment 44 housed within upper piston 22. Once locking key 24 has been interposed between land 42 and abutment 44, the piston is maintained in the high compression height position until the oil pressure signal is released in passage 14 and plunger bores 36.

During operation at the high compression height position, the oil pressure signal which forces high compression locking keys 24 and high compression plungers 28 into their locked, radially outward, position also forces low compression locking keys 26 and low compression plungers 30 to their radially inward position in which low compression locking keys 26 are not in contact with upper piston 22. This occurs because oil pressure is communicated between the various plunger bores by means of interconnecting passages 20 which hydraulically communicate high compression plunger bores 36 and low compression plunger bores 38. The force of the high pressure oil acting within plunger bores 38 forces low compression plungers 30 and their linked low compression locking keys 26 radially inward, releasing the upper piston 22 so it is able to move to its higher compression height. Once upper piston 22 reaches the higher compression height, high compression locking keys 24 will be allowed to move radially outwardly under the influence of high compression plungers 28 and against the biasing force of high compression plunger springs 32, so as to lock piston 10 in the high compression position.

Figure 4:
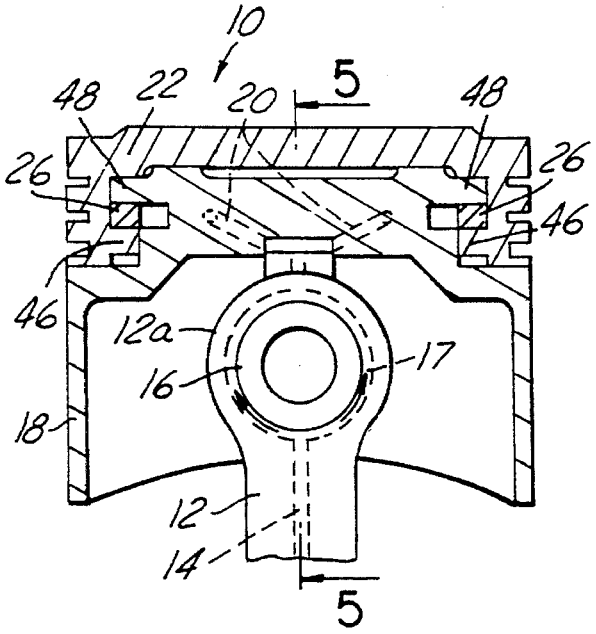
FIGS. 4 and 5 are sectional views of the piston of FIGS. 1–3, shown in a low compression position.
Figure 5:
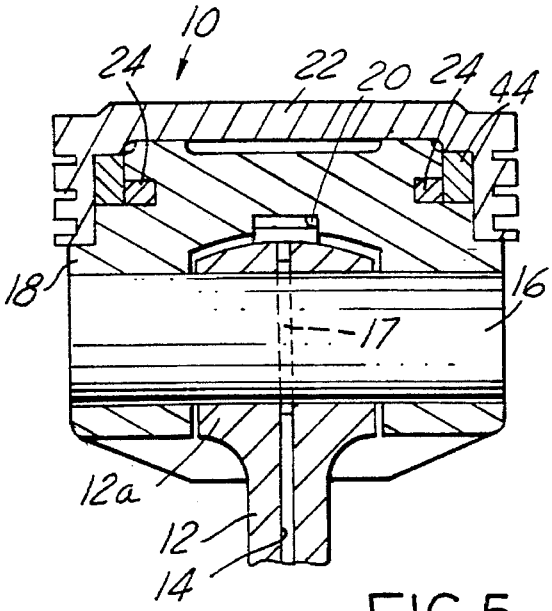
Figure 6:
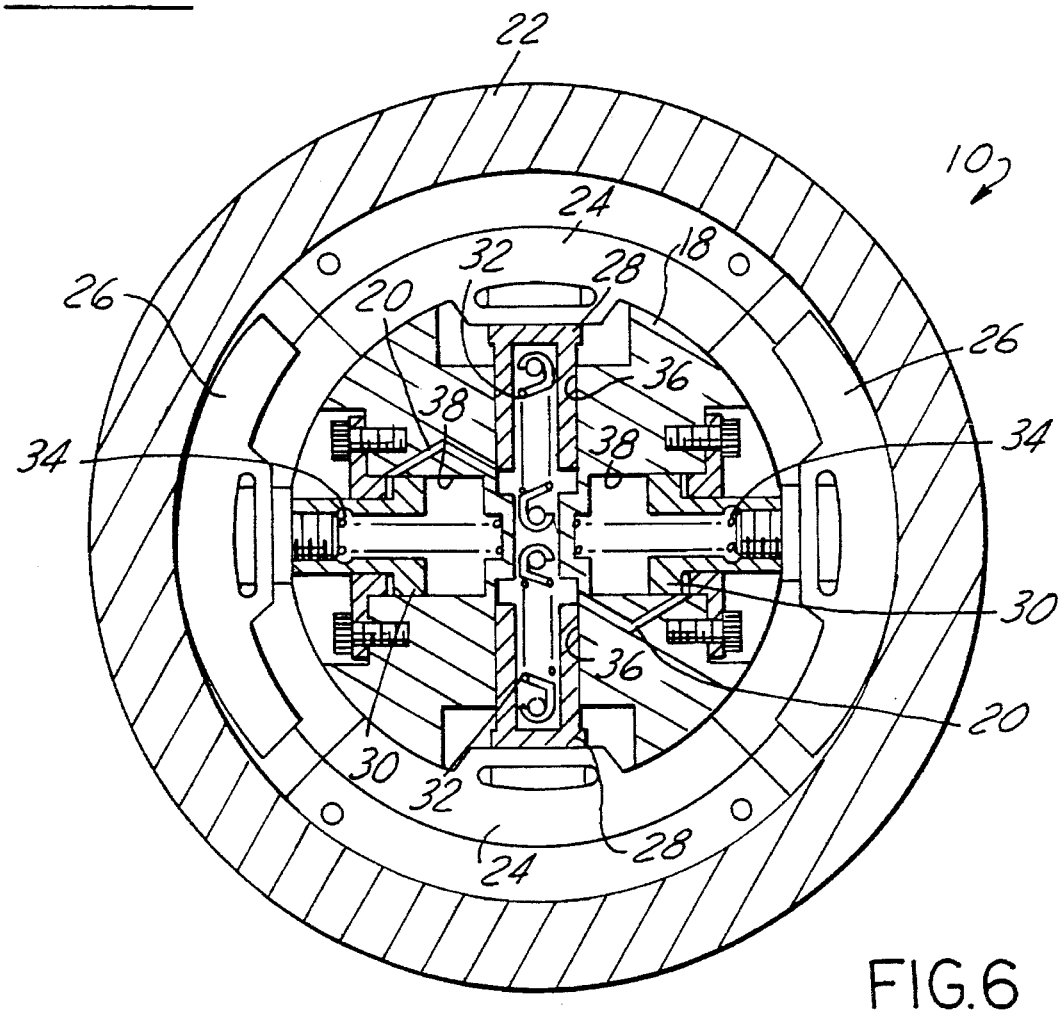
FIG. 6 is a plan view of the piston of FIGS. 4 and 5, in the same lower compression position.

FIGS. 4, 5, and 6 illustrate piston 10 in the lower compression height position. In this case, high compression locking keys 24 and their linked high compression plungers 28 are in a radially inward position because of the biasing force applied to the plungers by high compression plunger springs 32. In the lower compression height position, oil pressure within the various plunger bores is insufficient to overcome the force exerted on high compression plungers 28 by high compression plunger springs 32. Accordingly, high compression locking keys 24 move to the position shown in FIG. 5. This position may be described as the "home" or "at rest", or normally unlocked, position. With high compression locking keys 24 in the position as shown in FIG. 5, keys 24 are not available to engage with abutment 44 and, as a result, the upper piston 22 is allowed to move downward into closer proximity of wrist pin 16. Those skilled in the art will appreciate in view of this disclosure that inertia forces and cylinder pressure forces acting upon piston 10 in an operating engine provide all of the force required to slidingly move upper piston 22 with respect to lower piston 18 whenever both sets of locking 24 and 26 keys are disengaged.

Whenever piston 10 is placed in the lower compression height position, the upper and lower pistons must of course be locked together. This function is accomplished by low compression locking keys 26, which are, as shown in FIG. 4, interposed between land 48 formed on lower piston 18 and land 46 which is part of upper piston 22. Because springs 34 are compression springs which maintain low compression plungers 30 and low compression locking keys 26 in their radially outward position in the event that oil pressure is below a predetermined threshold, piston 10 will automatically assume the low compression height position of FIGS. 4–6 in the event that oil pressure falls below such a predetermined value. In this manner, an engine equipped with the present system will automatically revert to lower compression operation in the event that the oiling system has a defect.

Figure 7:
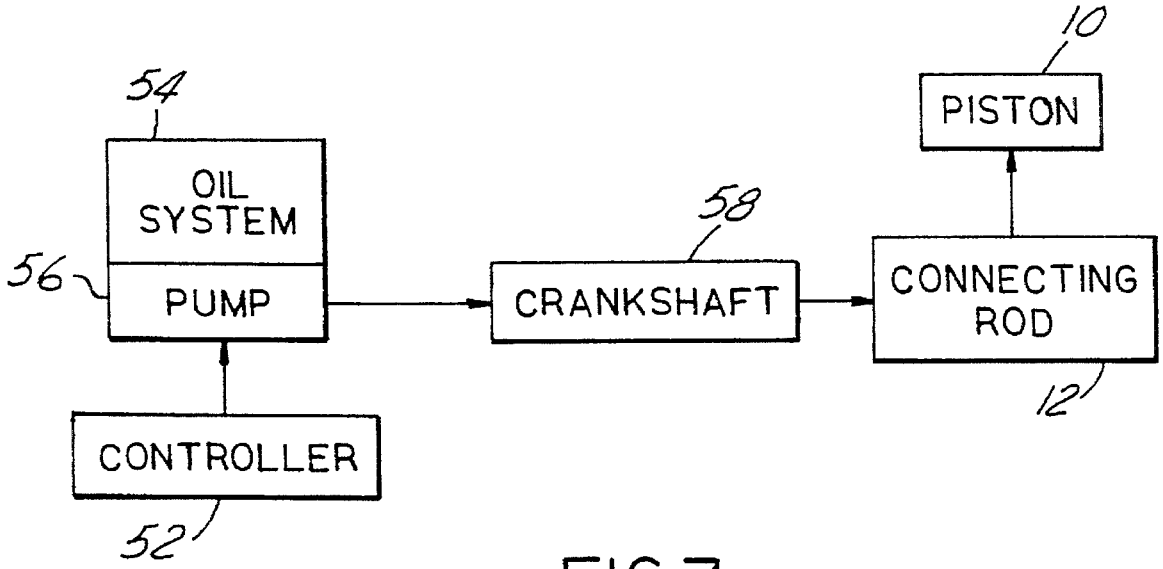
FIG. 7 is a schematic representation of a variable compression height piston and control system according to the present invention.

FIG. 7 illustrates a complete system, including a controller for operating the piston of the present invention. Controller 52 may sense a variety of engine operating parameters such as speed, load and operator demand. Controller 52 operates oil system 54, including pump 56 and associated valving including a pressure regulator(not shown), to supply oil to crankshaft 58 at a controlled pressure. In conventional fashion, oil is supplied via the main bearing bores (not shown) to crankshaft 58. Traveling through drillings in the crankshaft, the oil pressure communicates with connecting rod 12, again in conventional fashion, and thence to piston 10, as described above. In this manner, the compression height of piston 10 can be controlled by controller 52 as the controller governs the pressure of oil applied through connecting rod passage 14. As previously noted, controller 52 operates oil system 54 and pump 56 such that a relatively lower oil pressure is furnished to connecting rod in oil passage 14 when it is desired for an upper piston 22 to be in the lower compression height position, with a relatively higher pressure oil being furnished to connecting rod oil passage 14 via oil pump 56, as directed by controller 52 when it is desired for upper piston 22 to be in the higher compression height position.

While the invention has been shown and described in its preferred embodiments, it will be clear to those skilled in the arts to which it pertains that many changes and modifications may be made thereto without departing from the scope of the invention.

We claim:

1. A variable compression height piston for a reciprocating internal combustion engine having at least one piston coupled to a crankshaft by means of a connecting rod, with said piston comprising:

a lower piston coupled to said connecting rod;

an upper piston slidably carried upon said lower piston; and a hydraulically actuated mechanical latching system, interposed between the lower and upper pistons, for selectably maintaining said upper piston in a plurality of predetermined compression heights, wherein said latching system comprises a low compression latch for maintaining the upper piston at a lower compression height, and a high compression latch for maintaining the upper piston at a higher compression height.

2. A variable compression height piston according to claim 1, wherein said low compression latch has a normally engaged configuration, and said high compression latch has a normally disengaged configuration.

3. A variable compression height piston according to claim 1, wherein said latches are responsive to oil pressure signals communicated to the piston by means of an oil passage contained in said connecting rod.

4. A variable compression height piston according to claim 2, wherein said low compression latch comprises at least one low compression locking key which is linked with a radially extending low compression plunger slidably housed within the lower piston, with said plunger being elastically biased so as to urge the key into locking contact with the upper piston, with said plunger being responsive to oil pressure communicated to the piston by means of an oil passage in said connecting rod such that an elevation of oil pressure above a predetermined level within the connecting rod will cause said plunger to move from a radially outward position in which the locking key is in contact with the upper piston, to a radially inward position in which the locking key is free from contact with the upper piston, whereby the upper piston will be permitted to move up relative to the lower piston under the influence of inertial forces, so as to increase the compression ratio.

5. A variable compression height piston according to claim 4, wherein the low compression latch comprises a plurality of locking keys, with each of said keys being linked with a separate low compression plunger.

6. A variable compression height piston according to claim 1, wherein said low compression latch and said high compression latch are co-planar.

7. A variable compression height piston according to claim 2, wherein said high compression latch comprises at least one high compression locking key which is linked with a radially extending high compression plunger slidably housed within the lower piston, with said plunger being elastically biased so as to urge the key into an unlocked position with respect to the upper piston, with said plunger being responsive to oil pressure communicated to the piston by means of an oil passage in said connecting rod, such that once the low compression latch has been released due to an elevation of oil pressure above a predetermined level within the connecting rod, forces acting external to the piston will cause the upper piston to move away from the lower piston and into the higher compression height position, and the same elevation of oil pressure within the connecting rod will cause said high compression plunger to move from a radially inward position in which the locking key is not in contact with the upper piston to a radially outward position in which the locking key is in contact with the upper piston, such that the upper piston is locked in the higher compression height position.

8. A variable compression height piston according to claim 7, wherein the high compression latch comprises a plurality of locking keys, with each of said keys being linked with a separate high compression plunger.

9. A variable compression height piston according to claim 7, wherein the high compression latch will be released once the oil pressure within the connecting rod is reduced below the predetermined level, thereby allowing external forces acting upon the piston to cause the upper piston to move closer to the lower piston and into the lower compression height position, with the low compression latch moving to its engaged configuration once the upper piston is in the lower compression position.

10. A variable compression height piston for a reciprocating internal combustion engine having at least one piston coupled to a crankshaft by means of a connecting rod, with said piston comprising:

a lower piston coupled to said connecting rod;

an upper piston slidably carried upon said lower piston; and a hydraulically actuated latching system, interposed between the lower and upper pistons, for selectably maintaining said upper piston in a plurality of predetermined compression heights, with said latching system comprising a low compression latch for maintaining the upper piston at a lower compression height, and a high compression latch for maintaining the upper piston at a higher compression height.

11. A variable compression height piston according to claim 10, wherein said latches are responsive to oil pressure signals communicated to the piston by means of an oil passage contained in said connecting rod.

12. A variable compression height piston and control system for a reciprocating internal combustion engine, comprising:

a lower piston coupled to a connecting rod;

an upper piston slidably carried upon said lower piston;

a hydraulically actuated latching system, interposed between the lower and upper pistons, for selectably maintaining said upper piston in a plurality of predetermined compression heights, with said latching system comprising a low compression latch for maintaining the upper piston at a lower compression height, and a high compression latch for maintaining the upper piston at a higher compression height, with said latches being responsive to oil pressure signals communicated to the piston by means of an oil passage contained in said connecting rod;

an oil supply system for furnishing oil under pressure to said oil passage in the connecting rod; and a controller for operating the oil system so as to govern the pressure of oil applied through the connecting rod passage to the latching system.

13. A variable compression height piston and control system according to claim 12, wherein said controller operates the oil system such that a relatively lower oil pressure is furnished to said connecting rod oil passage when the upper piston is in the lower compression height and a relatively higher pressure is furnished to the connecting rod oil passage when the upper piston is in the higher compression height.

* * * * *